United States Patent [19]

Fietta et al.

[11] Patent Number: 4,867,083

[45] Date of Patent: Sep. 19, 1989

[54] MODULAR SEWING MACHINE ARRANGED TO CONTROL AUXILIARY DEVICES

[75] Inventors: Emilio Fietta, Milan; Ezio Maggi, Certosa Di Pavia; Franco Marchesi, San Martino Siccomario, all of Italy

[73] Assignee: Rimoldi S.r.l., Milan, Italy

[21] Appl. No.: 145,164

[22] Filed: Jan. 19, 1988

[30] Foreign Application Priority Data

Apr. 30, 1987 [IT] Italy ..... 20345 A/87

[51] Int. Cl.[4] ..... D05B 3/24; B05B 73/00

[52] U.S. Cl. ..... 112/168; 112/259; 112/255; 112/322; 112/163; 112/221; 112/165

[58] Field of Search ..... 112/168, 258, 259, 257, 112/255, 322, 163, 221, 165, 166, 199, 200, 202

[56] References Cited

U.S. PATENT DOCUMENTS

| | | | |
|---|---|---|---|
| 423,996 | 3/1890 | Harlow et al. | 112/255 X |
| 1,123,578 | 1/1915 | Onderdonk | 112/202 |
| 4,590,875 | 5/1986 | Sanvito et al. | 112/168 |
| 4,686,917 | 8/1987 | Braun | 112/311 |
| 4,700,645 | 10/1987 | Kefer et al. | 112/259 |

FOREIGN PATENT DOCUMENTS

| | | | |
|---|---|---|---|
| 361240 | 1/1973 | U.S.S.R. | 112/322 |

*Primary Examiner*—Andrew M. Falik
*Attorney, Agent, or Firm*—Hoffmann & Baron

[57] ABSTRACT

A sewing machine comprises a bed 3 on which a work-supporting table 3a is defined and from which a post 4 carrying a cantilevered support arm 5 provided with a needle-holding head 6 at its free end, rises up. An upper shaft 9 performing a rotating motion is housed within the arm 5 and it imparts a reciprocating movement, through a connecting rod-crank linkage 10, to a needle bar 11 vertically slidable in the head 6. Along the upper shaft 9 a plurality of eccentrics 19, 20, 21 are distributed to which auxiliary sewing operation devices 22, 32, 39 detachably associated with the sewing machine 1 are operativley engageable through respective connecting rods 23, 33, 50 and transferring motion mechanisms. A preformed opening 5 is formed in the support arm 5, through which connecting rod 50 is mounted to eccentric 21. An opening 36 is formed in support arm 5 through which stem 37 passes. As a result of the preformed openings in the support arm and the eccentrics along the upper shaft, the sewing machine of the present invention provides for the connection of auxiliary sewing operation devices, through the preformed openings, and to the eccentrics on the upper shaft of a basic version of the sewing machine.

7 Claims, 3 Drawing Sheets

FIG 3
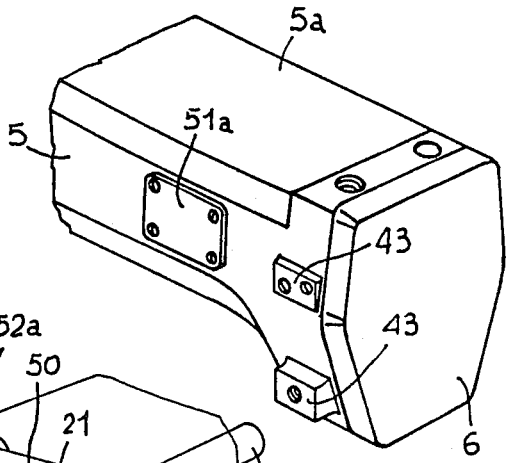
FIG 7
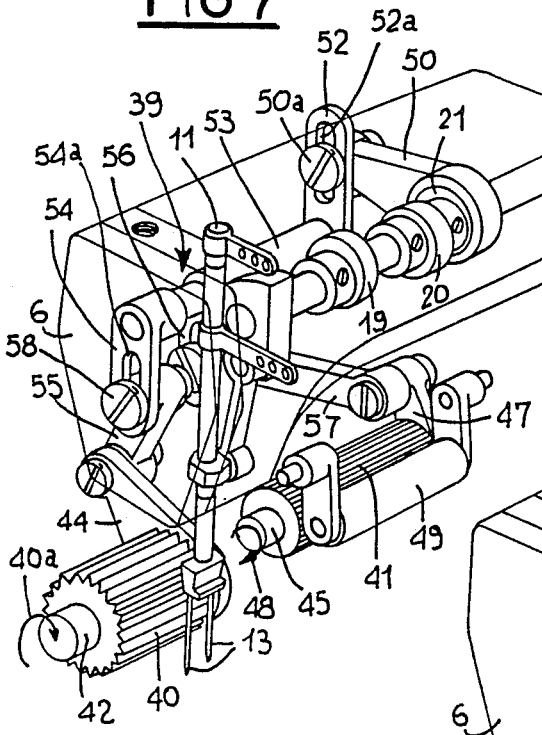
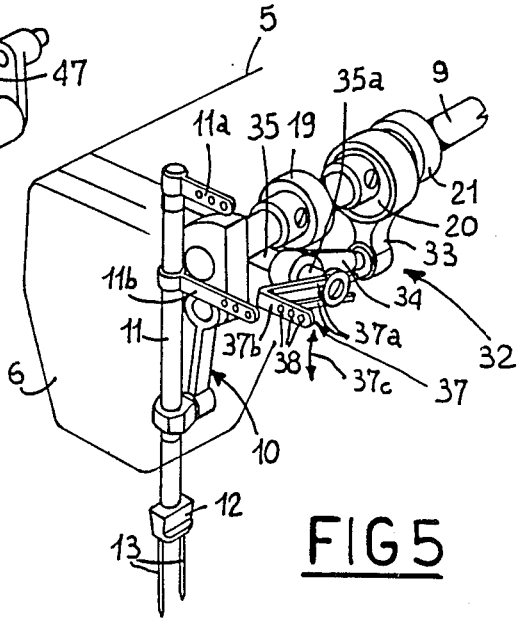
FIG 5

MODULAR SEWING MACHINE ARRANGED TO CONTROL AUXILIARY DEVICES

BACKGROUND OF THE INVENTION

1. Field of the Invention

The present invention relates to a modular sewing machine designed to control auxiliary sewing operation devices of the type comprising a bed on which a work-supporting table is defined, a post rising up from the bed, a support arm extending in cantilevered fashion from the post over the work-supporting table and provided with at least a removable cover, a needle-holding head located at one free end of the support arm and an upper shaft extending longitudinally in the support arm and rotation of which is operated to impart a reciprocating motion, through a connecting rod-crank linkage, to a needle bar slidably guided in a vertical direction in the head.

2. Prior Art

It is known that sewing machines are classified in different classes depending upon their structure and the type of sewing operation for which they are designed. Generally each of such classes involves a base version of the sewing machine and different subclasses, that is machines similar to the base one but provided with some additional devices making them adapted to execute particular working types while maintaining the functional characteristics proper to the base version.

In sewing machines of the traditional type it is not possible to create the different subclasses by merely applying said additional sewing operation devices to a sewing machine corresponding to the base version. In other words, it is necessary to produce many types of sewing machines each designed to execute a given type of sewing operation.

Obviously this condition involves high production and storage costs on the part of the manufacturer as well as important installation costs and maintenance charges on the part of the final user who must have many types of sewing machines at his disposal.

For the purpose of solving these problems sewing machines of the so-called "modular" type have been produced, said machines being conceived so that it is possible to accomplish a ready assembling of auxiliary sewing operation devices and consequently their transformation into different subclasses. To this end such sewing machines are provided with kinematic control mechanisms receiving the movement from the shafts housed in the machine bed and terminating in the region of openings formed in the work-supporting table. These kinematic mechanisms involve important increases in the sewing machine costs as necessarily they are comprised of several members that need to be guided and lubricated. Furthermore such increases in costs are not always justified since the presence of at least part of said kinematic mechanisms often appears superfluous.

It is also to be noted that the costs resulting from the arrangement of said kinematic mechanisms must be multiplied when the modular sewing machines are provided with interchangeable bases. In these cases in fact each of the bases to be associated with the machine must have all the kinematic control mechanisms for the auxiliary sewing operation devices.

SUMMARY OF THE INVENTION

It is an object of the present invention to solve the above mentioned drawbacks by means of a sewing machine arranged to receive and be combined with an auxiliary sewing operation devices without involving the important increases in costs currently found in known sewing machines of this type.

The foregoing and still further objects that will become more apparent in the following are substantially achieved by a modular sewing machine arranged to control auxiliary sewing operation devices wherein the support arm is provided with openings and at least a sleeve which is capable of bridging respective connecting rod and transmission linkages of the auxiliary sewing operation devices, when the latter are mounted on the basic sewing machine closed by closing members when not engaged by said connecting rods and transmission linkages.

BRIEF DESCRIPTION OF THE DRAWINGS

Further features and advantages of the invention will best be understood from the detailed description of a preferred embodiment of a modular sewing machine arranged to control auxiliary sewing operation devices given hereinafter by way of non-limiting example with reference to the accompanying drawings, in which: FIG. 3 is a perspective view of a detail shown in FIG. 2 and seen from the opposite side; FIG. 5 is a perspective front view of a thread tape up device housed in the support arm of the sewing machine; FIG. 7 is a perspective front view showing a supply roller and a rear feed roller both associated with the control device shown in FIG. 6.

DESCRIPTION OF THE PREFERRED EMBODIMENT

Figure 1:
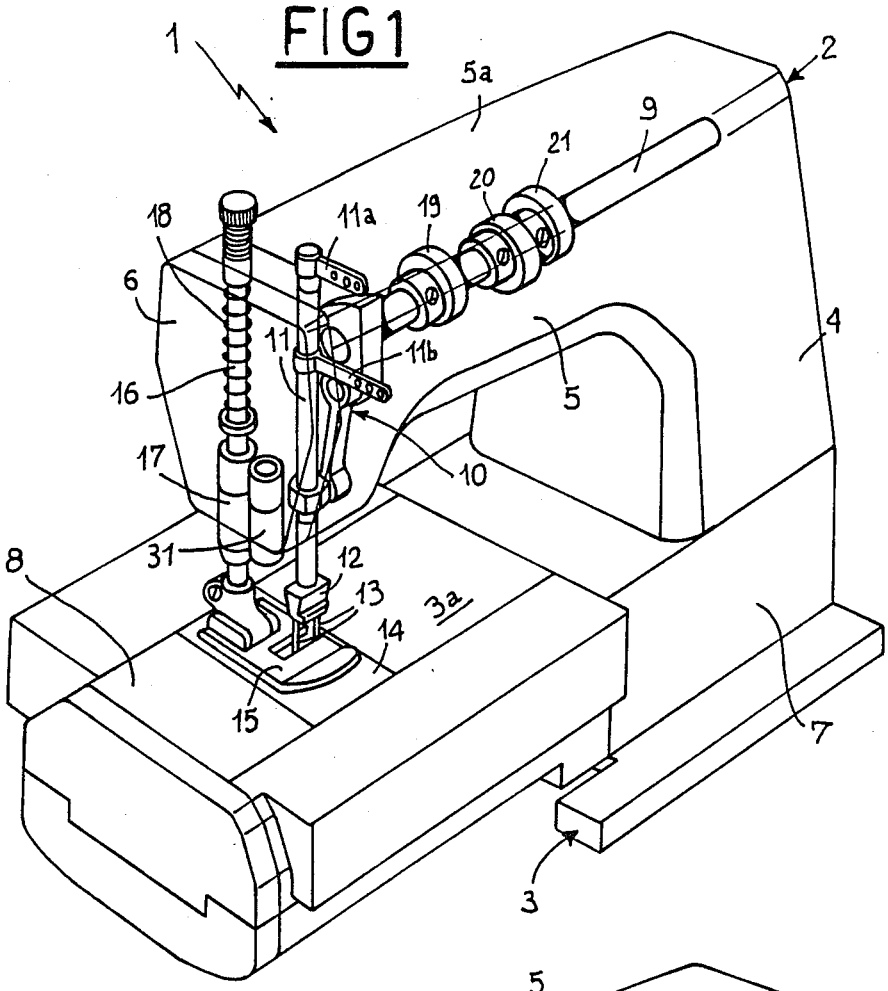
FIG. 1 is a diagrammatic perspective view of a sewing machine base version according to the invention.

Referring to the drawings and particularly to FIG. 1, a modular sewing machine arranged to control auxiliary sewing operation devices according to the present invention is identified by reference numeral 1.

In known manner, the sewing machine comprises a frame made up of a bed 3 at the top of which a work-supporting table 3*a* is defined. A post 4 rises up from bed 3 and it carries a support arm 5 extending in cantilevered fashion over the work-supporting table 3*a*. The support arm 5 is provided at its upper part with a removable cover 5*a* and it has a needle-holding head 6 at its free end.

Preferably the bed 3 is of the modular type, that is comprised of a fixed module 7 supporting the post 4, to which a movalbe module 8 is detachably engaged. Different movable and interchangeable modules 8 are associated with the fixed module 7, each of them being adapted to execute a determinate type of sewing operation.

As shown in the drawings in which the frame 2 is partially drawn in phantom, the support arm 5 rotatably houses an upper shaft 9 rotation of which is operated in known manner by means of a toothed belt connecting it to a rotating shaft housed in the machine bed 3 and not shown, which is in turn driven by a motor.

The upper shaft 9 extends longitudinally in the support arm 5 and terminates close to the head 6 where, through a connecting rod-crank linkage 10, it imparts a reciprocating motion to a needle bar 11 slidably engaged in said head in a vertical direction. The needle bar 11 completely crosses the head 6 and is provided at its lower part with a clamp 12 to which one or more needles 13 are fixed which are designed to operate thorugh a needle plate 14 disposed flush with the work-supporting table 3*a* along which the fabric being worked is fed.

Acting on the needle plate 14 is a presser foot 15 supported by a presser foot holder 16 slidably guided in a vertical direction within the head 6 through a guide sleeve 17. A spring 18 acts on the presser foot holder 16 to urge the presser foot against the needle plate 14.

In an original manner, in accordance with the present invention, a number of eccentrics are distributed along the upper shaft 9; they are designed to constitute the kinematic base mechanism for the control of the auxiliary sewing operation devices being detachably associable with the sewing machine 1, as more clearly shown in the following.

In greater detail, in the embodiment shown a first eccentric 19 followed by a second eccentric 20 and a third eccentric 21 are provided on the upper shaft and they are disposed spaced apart from each other starting from the head 6.

Figure 4:
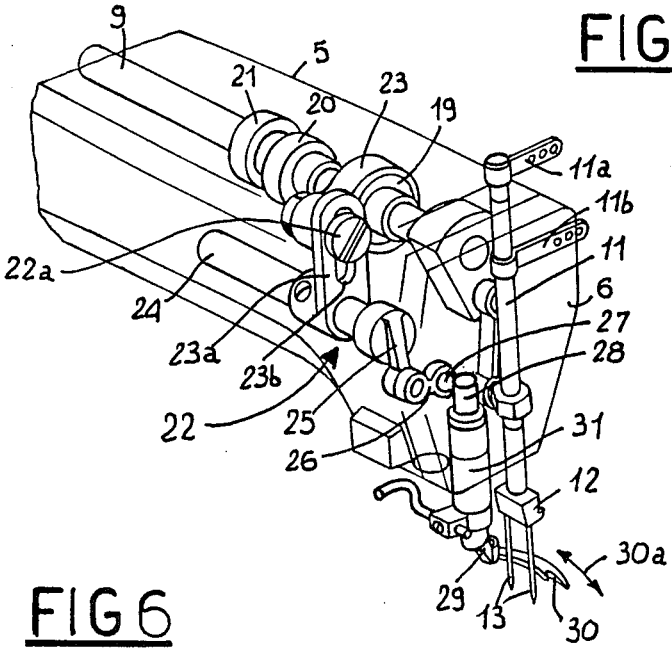
FIG. 4 is a perspective rear view of a control device for the top spreader housed in the support arm of the sewing machine.

Referring particularly to FIG. 4, the first eccentric 19 is designed to be associated with a control device for a top thread spreader 22. Such a device is associated with the sewing machine 1 when it is wished to lay down a covering thread between two or more parallel seams carried out for example along the opposite edges of two fabrics being worked which are disposed alongside each other.

The device 22 is comprised of a first connecting rod 23 operatively engaged on the first eccentric 19 and connected to a first lever 23*a* fastened to a first countershaft 24 rotatably carried at the inside of the support arm 5 in known manne and therefore not shown. The countershaft 24 extends in parallel to the upper shaft 9 and fixedly carries, at its end facing the head 6, a drive arm 25 connected through an idler shackle 26 to a connecting arm 27 in turn carried by a support shaft 28 supporting a top thread spreader member 30 at its lower part through a connecting shank 29. The support shaft 28 substantially extends in a vertical direction inside the head 6 and is rotatably supported by a sleeve 31 premounted on the sewing machine frame and housed adjacent the sleeve 17 engaging the presser foot holder 16 (FIG. 1).

In operation, the countershaft 24, which is operated by lever 23*a* in turn driven by the connecting rod 23, performs an oscillatory motion about its own axis the amplitude of which can be adjusted by suitably positioning a pin 22*a* along an elongated opening 23*b* provided on the lever itself, said pin connecting the lever to the connecting rod 22. The oscillations of the countershaft 24 are transmitted to the support shaft 28 via the drive arm 25, shackle 26 and arm 27, the latter being connected to the shackle through a ball joint. Consequently the support shaft 28 as well carries out an oscillatory motion about its own axis cuasing the spreader 30 to perform a reciprocating motion according to the arrow 30*a* in FIG. 4.

Turning now to FIG. 5, the second eccentric 20 is designed to be associated with a thread tap up device 32 for tensioning at least a needle thread. Such a device has to be combined with the sewing machine 1 when for example the latter is arranged to execute a chain stitch in order to tak eup the excess needle thread or threads that tend to be produced after the formation of each stitch.

Figure 2:
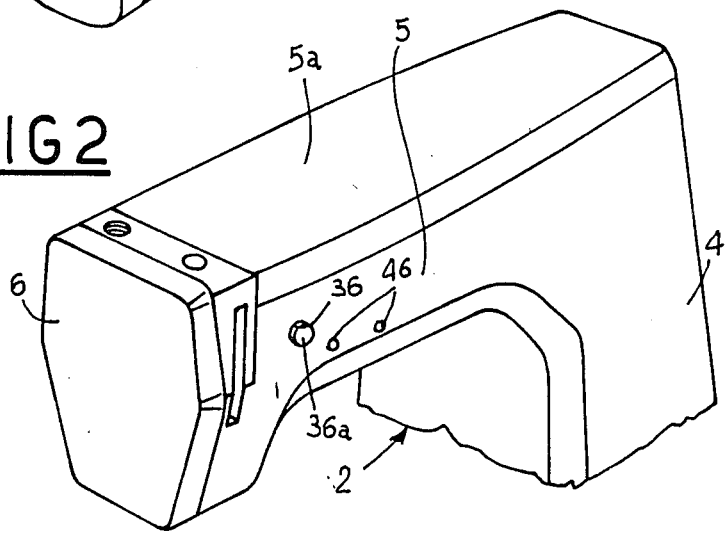
FIG. 2 is a perspective front view of a portion of the sewing machine frame.

To this end the device 32 is comprised of asecond connecting rod 33 operatively engaged with the second eccentric 20 and acting on a second lever 34 fixed to a stem 35 rotatably engaged in the support arm 5. In greater detail, the stem 37 extends horizontally at right angles to the upper shaft 9 and one of its ends 35*a* projects from the support arm 5 through a hole 36 suitably performed on the front wall of the support arm. Said hole shown in FIG. 2 is hermetically closed by a plug 36*a* when the device 32 is not attached to the sewing machine 1.

A thread taking up member 37 is engaged to said end 35*a*; it has a fork-shaped portion 37*a* extending radially to the stem 35 and adapted to be suitably positioned according to its longitudinal extension, and is followed by a tensioning wing 37*b* projecting at the front of the sewing machine 1 and provided with one or more holes 38 to allow respective needle threads to pass through.

In operation the connecting rod 33 through lever 34 causes the operation of the stem 35 which performs an oscillatory motion about its own axis. As a result, the wing 37*b* of the thread taking up device 37 carries out an oscillatory motion as well, according to the arrow 37*c* in FIG. 5, said oscillatory motion having an adjustable amplitude depending upon the longitudinal sliding of the fork-shaped portion 37*a* on the end 35*a*. In the example shown the thread taking up member 37 is designed to move in phase opposition to the needle bar 11 and to coopeate with thread-pulling members 11*a* and 11*b* conventionally arranged thereon to cause the recovery of excess needle thread or threads.

Figure 6:
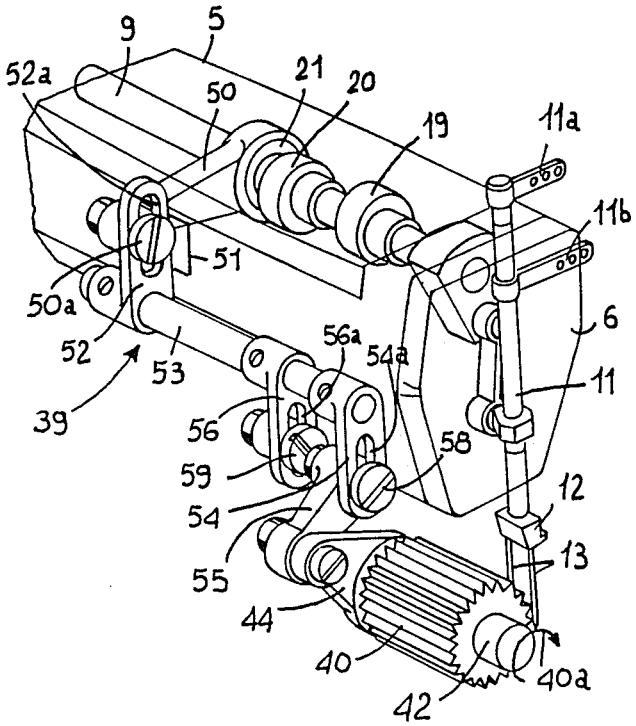
FIG. 6 is a perspective rear view of a control device for the fabric feed rollers with which a feed roller acting rearwardly to the needle bar is associated.

As shown in FIGS. 6 and 7, a third eccentric 21 is designed to be associated with a control device 39 for fabric feed rollers. Such a device is arranged to operate a rear feed roller 40 and a front feed roller 41 either individually or simultaneously.

In known manner, the feed roller 40 acts at the rear of the presser foot holder 16 referring to the fabric feed direction, and flush with the work-supporting table 3*a*. Roller 40 is provided with a pivot 42 allowing it to be rotatably supported through conventional brackets not shown. Said brackets are detachably fixed to engagement housings 43 suitably located on the rear wall of head 6, as clearly shown in FIG. 3. Conventionally, associated with the feed roller 40 is an actuator arm 44 designed to move alternately about the axis of pivot 42 in order to cause, through a one-day clutch not shown, the intermittent rotation of the roller according to the rotation direction shown by the arrow 40*a*.

Similarly to what described with reference to the feed roller 40, the front feed roller 41 is rotatably supported by a pivot 45 through brackets not shown as known per se, detachably fixed to the front wall of the support arm 5 by means of the threaded holes 41 shown inFIG. 2. The feed roller 41 toois provided with an actuator arm 47 designed to move alternately about the axis of pivot 45 in order to cause, through a one-way clutch, the intermittent rotation of the roller according to the arrow 48 shown in FIG. 7. In addition a pressure counter-roller 49 known per se can be associated with the feed roller 41.

In the embodiment shown the feed roller 41 acts at a higher position than the work-supporting table 3*a*, but it could also act flush with said table.

The control device 39 for rollers 40 and 41 is comprised of a third connecting rod 50 projecting from the support arm 5 through a suitable opening 51 formed in the rear wall thereof. As shown in FIG. 3, the opening 51 is hermetically closed by a plate 51*a* when the device 39 is not attached to the sewing machine 1.

the connecting rod 50 acts, externally to the support arm 5, on a third lever 52 fixed to an outer countershaft 53 rotatably supported with respect to the support arm 5 and extending parallelly to the upper shaft 9. The outer countershaft 53 fixedly carries a drive arm 54 for the feed roller 40 operatively connected to the actuator arm 44 of said rolelr through a first shackle 55. The outer counterhsaft 53 is also provided with a drive shaft 56 for the feed roller 41, connected to the actuator shaft 47 of said roller through a second shackle 57.

The device 39 is designed to be combined with the sewing machine 1 when, in order to execute particular sewing operation, it is necessary to use either the feed roller 40 or the feed roller 41 or both of them.

In operation the actio of the connecting rod 50 on the lever 52 causes the outer countershaft 53 to perform an oscillatory moiton about its own axis, the amplitude of which is determined by suitably positioning a pivot 50*a* connecting the connecting rod 50 to the lever itself, along an elongated opening 52*a* formed in said lever 52. The oscillations of the outer countershaft 53 are transmitted to the actuator arms 44 and 47 through the connections joining the respective arms 54, 56 to the respective shackles 55, 57. The amplitudes of oscillation of the actuator arms 44 and 47 can be individually adjusted by suitably positioning the pivots 58 and 59 connecting the drive shafts 54 and 56 to their respective shackles 55, 57, along corresponding elongated openings 54*a* and 56*a* formed in said drive shafts.

Devices 22, 32 and 39 can be associated with the base version of the sewing machine 1 either individually or in combination in order to transform it into different subclasses thereof adapted to meet particular sewing operation requirements.

Advantageously, for the purpose it is sufficient to remove the cover 5*a* of the support arm 5 in order to have access to the latter and accomplish the assembling of the members forming the sewing operation devices to be associtaed with the sewing machine.

It is to be noted in fact that the sewing machine in question enables an operator to readily connect auxiliary sewing operation devices thereto, although in its base version it exhibits a very reduced number of additional members, actually restricted to the eccentrics and to the housings adapted to accommodate the different members forming said auxiliary sewing operation devices.

It is understood that the invention as conceived is susceptible of many modifications and variations all falling within the scope of the inventive idea characterizing it. In particular any number of eccentrics may be provided on the upper shaft and to said eccentrics it is possible to connect auxiliary sewing operation devices different than those previously described by way of example.

What is claimed is:

1. A modular sewing machine arranged to control auxiliary sewing operation devices, comprising:

a frame having a bed, a post, a support arm, and a needle-holding head, said bed being formed by a fixed module to which a movable interchangeable support module having a work-supporting table is detachably associated, said post rising up from said fixed module and supporting said support arm in a cantilevered manner over said work-supporting table, said support arm having a free end, and being upwardly closed by at least a removable cover, and said needle-holding head being located at said free end of said support arm;

a needle bar slideably guided in a vertical direction in said needle-holding head;

an upper shaft longitudinally housed within said support arm, said upper shaft capable of being rotated and said upper shaft being connected to said needle bar through a connecting rod-crank linkage, so as to impart a reciprocating motion to said needle bar;

a plurality of eccentrics distributed along said upper shaft and capable of being engageably associated with auxiliary sewing operation devices, each said sewing operation device being detachably mountable to said modular sewing machine and having connecting rod and transmission linkage for connecting each said auxiliary sewing operation device to said modular sewing machine;

openings preformed in said support arm to allow said auxiliary sewing operation devices to be associably engaged with said eccentrics on said upper shaft within said support arm, so as to provide different sewing operation capabilities to said modular sewing machine when said auxiliary sewing operation devices are detachably mounted to said modular sewing machines and associably engageable with said eccentrics;

at least one sleeve provided to said support arm, said sleeve and said openings being capable of housing said respective connecting rod and transmission linkage of said auxiliary sewing operation devices when said auxiliary sewing operation devices are mounted on said sewing machine; and a plurality of closing members for closing said openings when said connecting rod and transmission linkage of said auxiliary sewing operation devices are not associably engaged with said modular sewing machine.

2. The modular sewing machine as claimed in claim 1, wherein at least a first eccentric of said plurality of eccentrics, is capable of being connectively associated with a control device for a top thread spreader, which comprises:

a connecting rod engaged with said first eccentric;

a countershaft rotatably housed in said support arm and extended parallely to said upper shaft;

a lever fastened to said countershaft and pivoted to one end of said ocnnecting rod so as to impart to said countershaft, an oscillatory motion about the axis of said countershaft;

a support shaft extending along a substantially vertical axis and having a lower end, said support shaft being rotatably engaged within said sleeve mounted on said needle-holding head, and extending from said needle-holding head;

an idler shackle acting between an arm and a drive arm extending from said countershaft, so as to impart to said support shaft, an oscillatory motion about the axis of said support shaft; and a top thread spreader connected to said lower part of said support shaft.

3. The modular sewing machine as claimed in claim 1, wherein said support arm inlcudes a front end portion, and wherein, at least a second eccentric of said plurality of eccentrics, is capable of being connectively associated with a control device for tensioning at least one needle thread, which comprises:

a connecting rod operatively engaged with said second eccentric;

a stem rotatably housed in said support arm and disposed along an axis perpendicular to the axis of said upper shaft, and one end of said stem projecting through an opening provided in said front end portion of said support arm;

a lever integral to said stem and operatively connected to said connecting rod so as to impart to said stem, an oscillatory motion about the axis of said stem; and a thread tensioning member engaged with said stem so as to cooperate with thread pulling members carried by said needle bra.

4. The modular sewing macine as claimed in claim 1, wherein said support arm has a rear end portion, and wherein at least a third eccentric of said plurality of eccentrics, is capable of being connectively associated with a control device for at least a fabric feed roller, said control device comprising:

a connecting rod operatively engaged with said third eccentric, one end of said connecting rod projecting through an opening formed in said rear end portion of said support arm;

an outer countershaft rotatably supported externally to said support arm, and extending along an axis parallel to the axis of said upper shaft;

a lever integral to said outer countershaft and engaging with an end of said connecting rod so as to impart to said outer countershaft, an oscillatory motion about the axis of said outer countershaft; and at least one drive arm fixedly fastened to said outer countershaft and acting at least on a shackle connected to said fabric feed roller so as to cause operation of said fabric feed roller.

5. The modular sewing machine as claimed in claim 4, wherein said needle bar has a front and a rear, and wherein said fabric feed roller acts at said rear of said needle bar.

6. The modular sewing machine as claimed in claim 4, wherein said fabric feed roller acts at said front of said needle bar.

7. The modular sewing machine as claimed in claim 4, wherein at least two feed rolelr drive arms are fastened to said outer countershaft, said feed roller drive arms being further connected to a feed roller acting at said rear of said needle bar, and a feed roller acting at said front of said needle bar, respectively.

* * * * *